US010433597B2

(12) United States Patent
Hewlett

(10) Patent No.: US 10,433,597 B2
(45) Date of Patent: Oct. 8, 2019

(54) EVAPORATIVE NECK COOLING DEVICE

(71) Applicant: GUSTO OUTFITTERS, LLC., Austin, TX (US)

(72) Inventor: John Hewlett, Austin, TX (US)

(73) Assignee: Gusto Outfitters, LLC, Austin, TX (US)

( * ) Notice: Subject to any disclaimer, the term of this patent is extended or adjusted under 35 U.S.C. 154(b) by 0 days.

(21) Appl. No.: 15/365,366

(22) Filed: Nov. 30, 2016

(65) Prior Publication Data

US 2018/0146727 A1 May 31, 2018

(51) Int. Cl.
*A41D 23/00* (2006.01)

(52) U.S. Cl.
CPC ..... *A41D 23/00* (2013.01); *A41D 2023/002* (2013.01)

(58) Field of Classification Search
CPC ..... A41D 2023/002; A41D 2023/004; A41D 23/00; A41D 13/157; A42B 1/00804; A42B 1/041; A42B 7/00
USPC ..... 2/209, 206, 208, 339, 310–312, 338
See application file for complete search history.

(56) References Cited

U.S. PATENT DOCUMENTS 1,655,973 A * 1/1928 Ross ..... D06B 11/00 8/482
2,201,716 A * 5/1940 Davis, Jr. ..... D04B 9/18 66/125 R
2,806,222 A * 9/1957 Carpenter ..... A41D 1/22 2/207
2,858,541 A * 11/1958 Mangan ..... A41B 9/06 2/113
3,029,438 A 4/1962 Henschel
3,738,692 A * 6/1973 Martuch ..... A01K 91/04 289/1.2
4,342,260 A * 8/1982 Sala ..... B41F 15/0863 101/123
4,641,655 A 2/1987 Abt
4,723,325 A * 2/1988 Perry ..... A41D 20/00 2/181
4,805,619 A 2/1989 Swearingen
5,088,549 A 2/1992 Schneider
5,400,617 A 3/1995 Ragonesi et al.
5,507,793 A 4/1996 Hodges
5,572,745 A 11/1996 Mainus
5,745,921 A 5/1998 Mitchell et al.
5,750,104 A 5/1998 Sipos
5,867,835 A * 2/1999 Dabbieri ..... A41D 23/00 2/171
6,145,131 A 11/2000 Huff
(Continued)

*Primary Examiner* — Gloria M Hale
(74) *Attorney, Agent, or Firm* — Travis R. Banta; TechLaw Ventures, PLLC

(57) ABSTRACT

An evaporative neck cooling device made from a plurality of separate circular fabric bands that are stacked one on top of another and are held together by a pair of fabric clasps that are each tied together in a nail knot at opposite sides of the stacked plurality of circular fabric bands, thereby providing a smooth wearable evaporative cooling device, and wherein the separate circular fabric bands provide increased surface area to enhance evaporation yet also cover one another to slow evaporation such that when the separate fabric bands jostle around one another on the user's neck, they permit different bands be exposed to the ambient air and different bands be covered by other bands at different times.

20 Claims, 7 Drawing Sheets

(56) References Cited

U.S. PATENT DOCUMENTS

| | | | | |
|---|---|---|---|---|
| 6,314,585 | B1 * | 11/2001 | Mann | A41D 27/08 2/243.1 |
| 6,779,237 | B1 * | 8/2004 | Stoltenberg | A44C 15/005 28/143 |
| 7,096,511 | B2 * | 8/2006 | Cohen | A41D 15/00 2/206 |
| D537,609 | S * | 3/2007 | Horowitz | D2/500 |
| 7,721,349 | B1 | 5/2010 | Strauss | |
| 8,321,963 | B2 * | 12/2012 | Diaz | A41D 23/00 2/207 |
| 9,121,642 | B2 * | 9/2015 | Ackroyd | D03D 15/00 |
| 2007/0094768 | A1 * | 5/2007 | Moudgill | A42B 1/041 2/171 |
| 2007/0278264 | A1 * | 12/2007 | Chesal | A47D 13/025 224/160 |
| 2008/0311166 | A1 * | 12/2008 | Wimer | A61K 8/0208 424/402 |
| 2010/0229283 | A1 * | 9/2010 | Diaz | A41D 23/00 2/207 |
| 2012/0227856 | A1 * | 9/2012 | Sinacori | D03D 1/00 139/420 R |

* cited by examiner

EVAPORATIVE NECK COOLING DEVICE

TECHNICAL FIELD

The present invention relates to evaporative cooling clothing accessories that keep a user cool by water evaporation.

SUMMARY OF THE INVENTION

The present invention provides an evaporative neck cooling device, comprising: a plurality of circular fabric bands, wherein each of the circular fabric bands is formed from a continuous circle of material and are physically separated from one another, and wherein each of the circular fabric bands is stacked on top of one another; and a pair of clasps, each clasp wrapping around the stacked plurality of circular fabric bands, wherein each clasp is made of a fabric strand tied in a nail knot around the stacked plurality of circular fabric bands, and wherein each of the clasps is placed at opposite sides of the stacked plurality of circular fabric bands.

Preferably, the clasps and the circular fabric bands are all made of the same fabric which is preferably cotton cut from parallel sections of a torso of a T-shirt in 10 to 25 circular bands that are each from ¼ to 1½ inches thick.

Advantageously, the use of a nail knot provides a smooth wearable surface with no sharp knot ends or edges pressing against the user's neck.

Advantageously as well, the separate circular fabric bands provide increased surface area to enhance evaporation. However, having separate fabric bands covering one another at different times also slows the speed of evaporation. Therefore, having the separate fabric bands jostle around one another on the user's neck permits the surfaces of different bands be exposed to the air (to thereby enhance evaporation) while other bands are covered by one another at different times (to thereby prolong the evaporative effect). The present invention thus provides an optimal combination of fabric bands and an optimal design to hold these bands together such that cooling effectiveness is itself optimized.

DETAILED DESCRIPTION OF THE DRAWINGS

Figure 1:
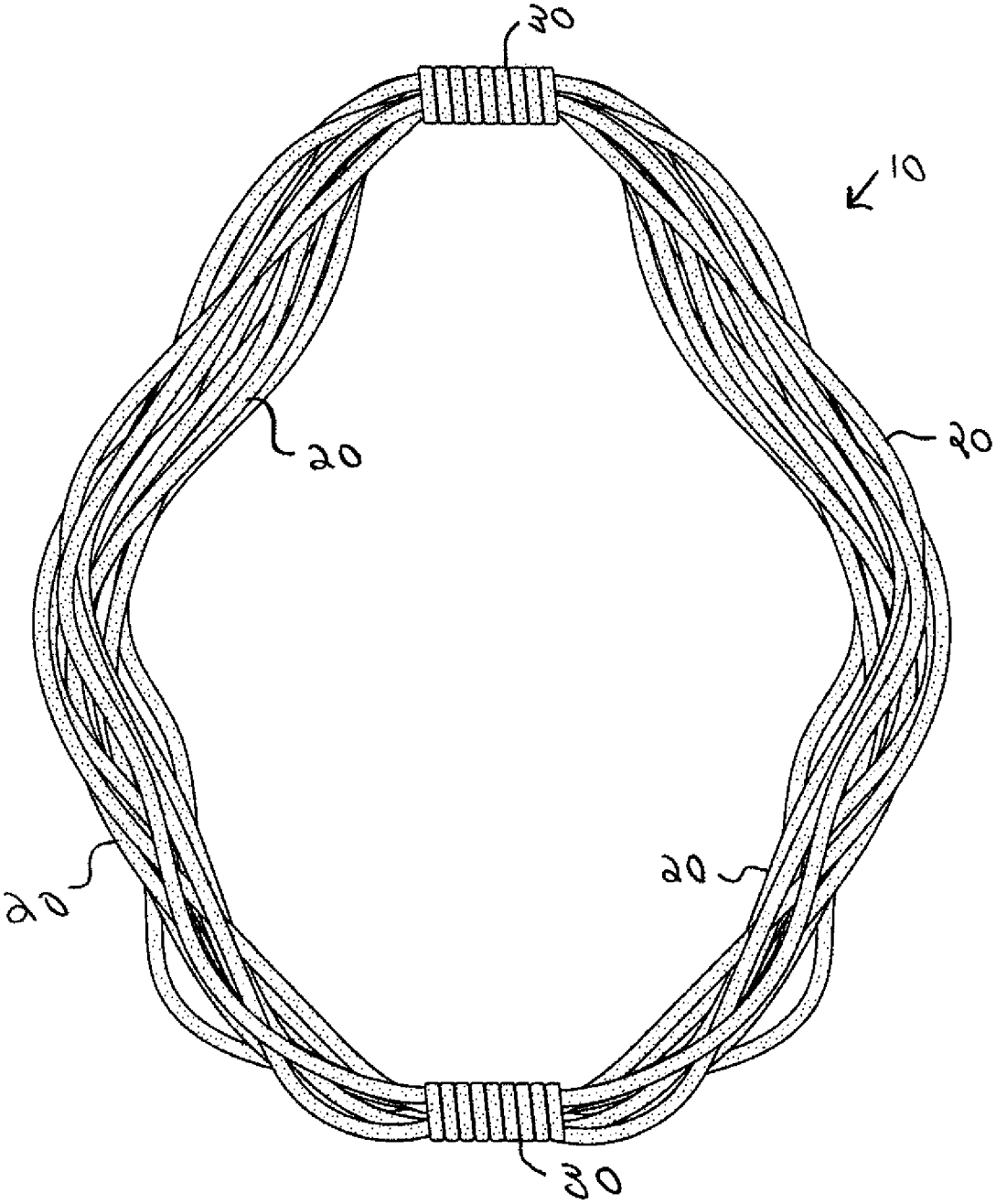
FIG. 1 is a front plan view of the present neck cooler.
Figure 2:
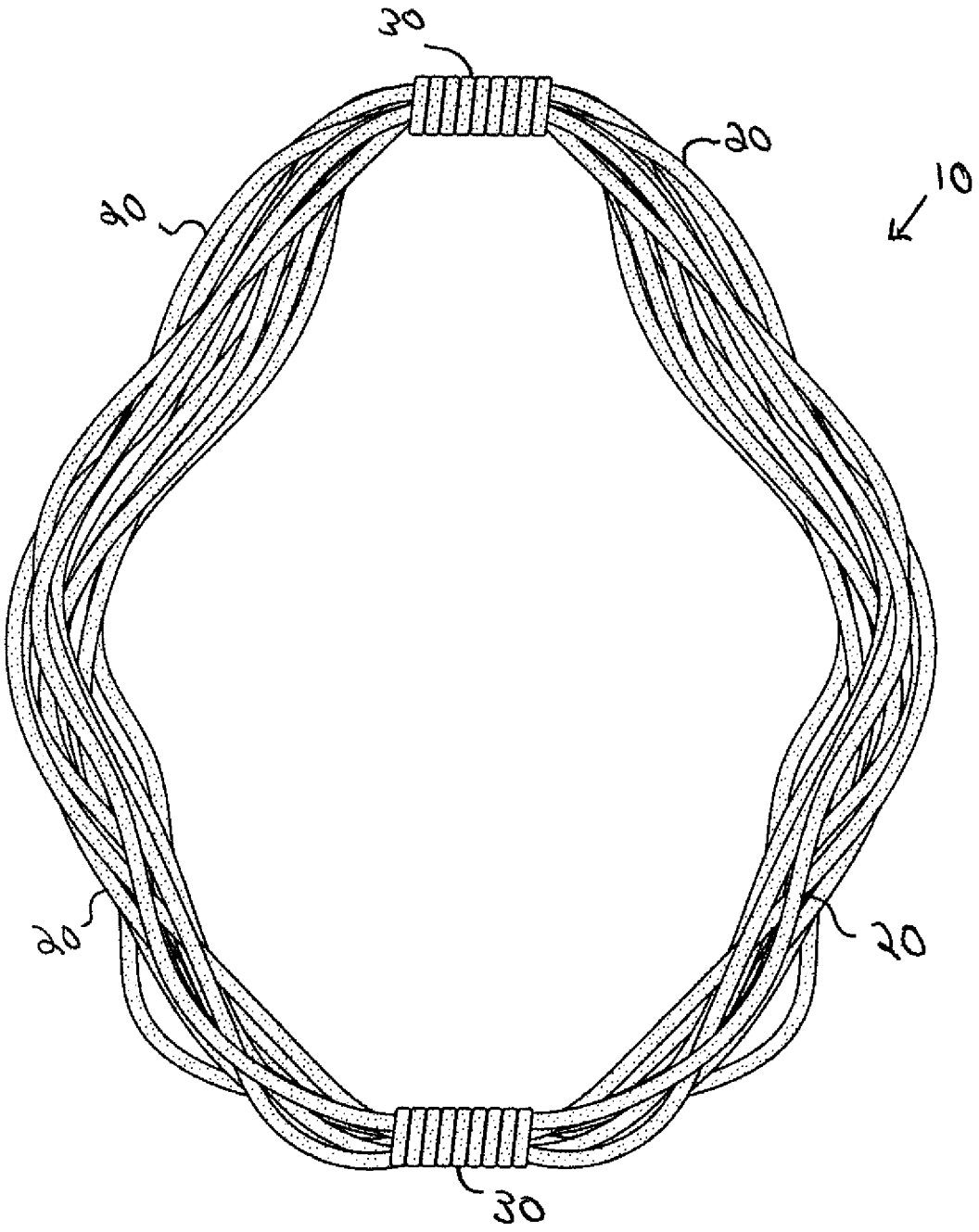
FIG. 2 is a back plan view of the present neck cooler.
Figure 3:
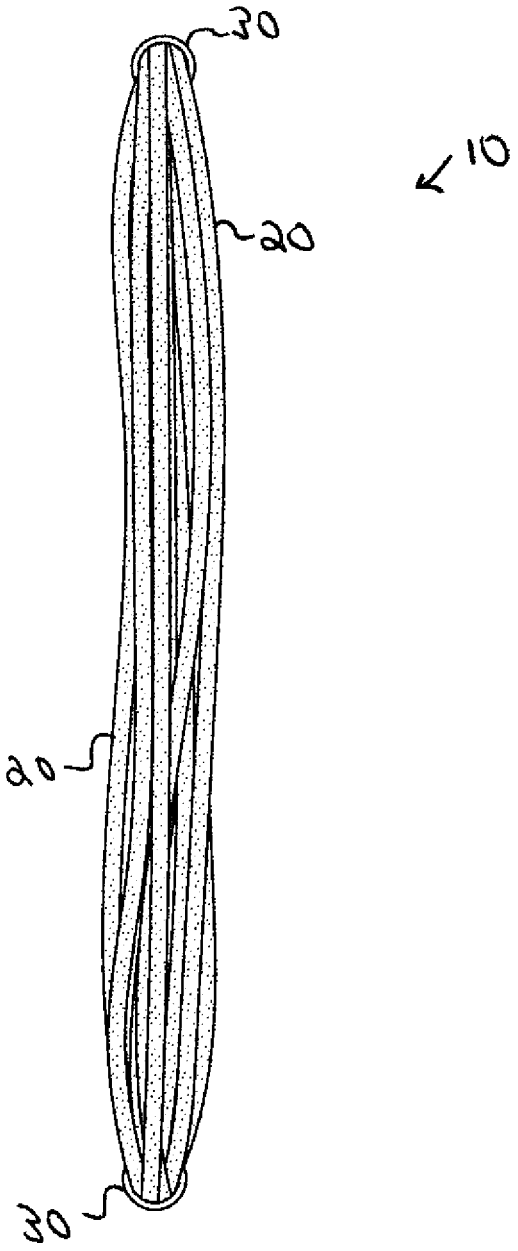
FIG. 3 is a side view of the present neck cooler.
Figure 4:
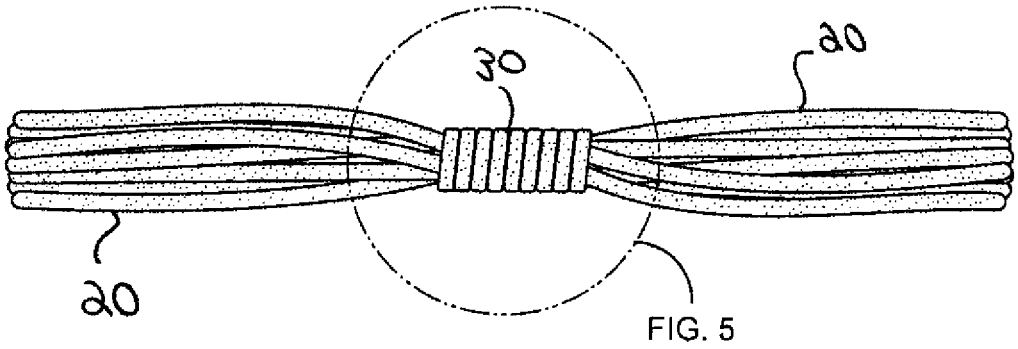
FIG. 4 is a top view of the present neck cooler.
Figure 5:
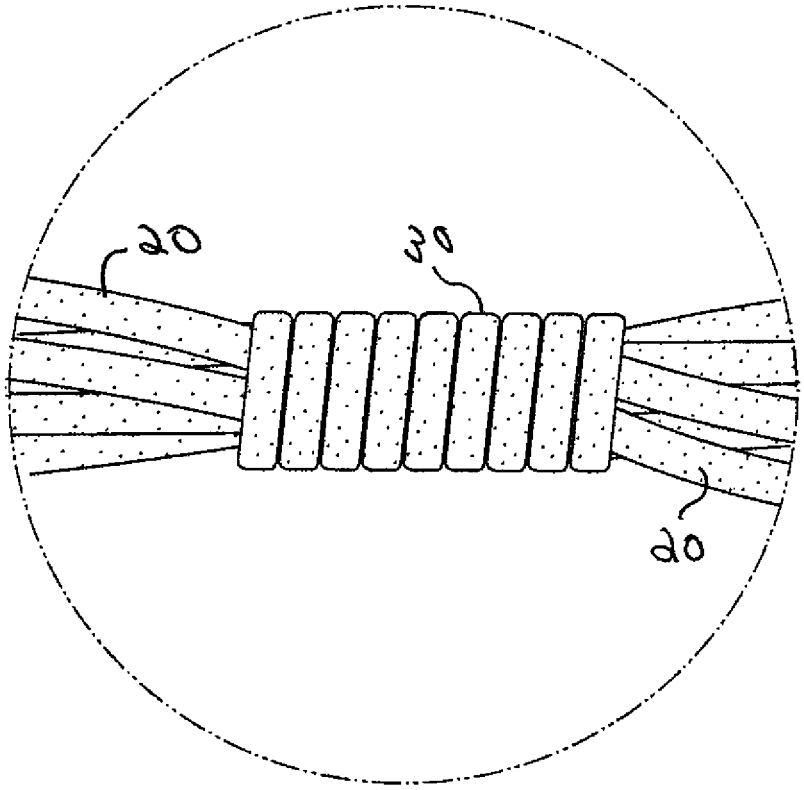
FIG. 5 is a close-up view of one of the clasps.
Figure 6:
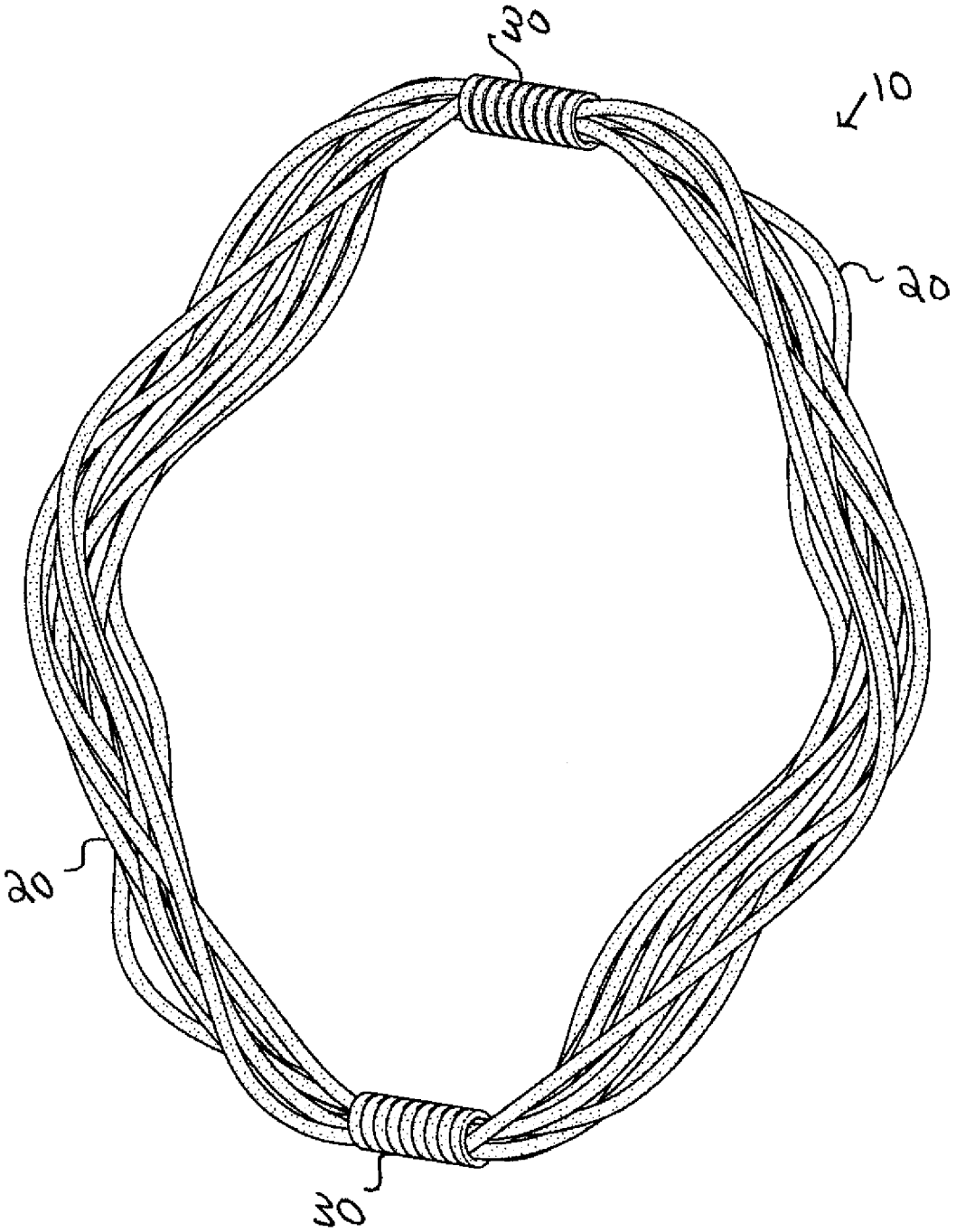
FIG. 6 is a perspective view of the neck cooler in an unfolded position prior to use.
Figure 7:
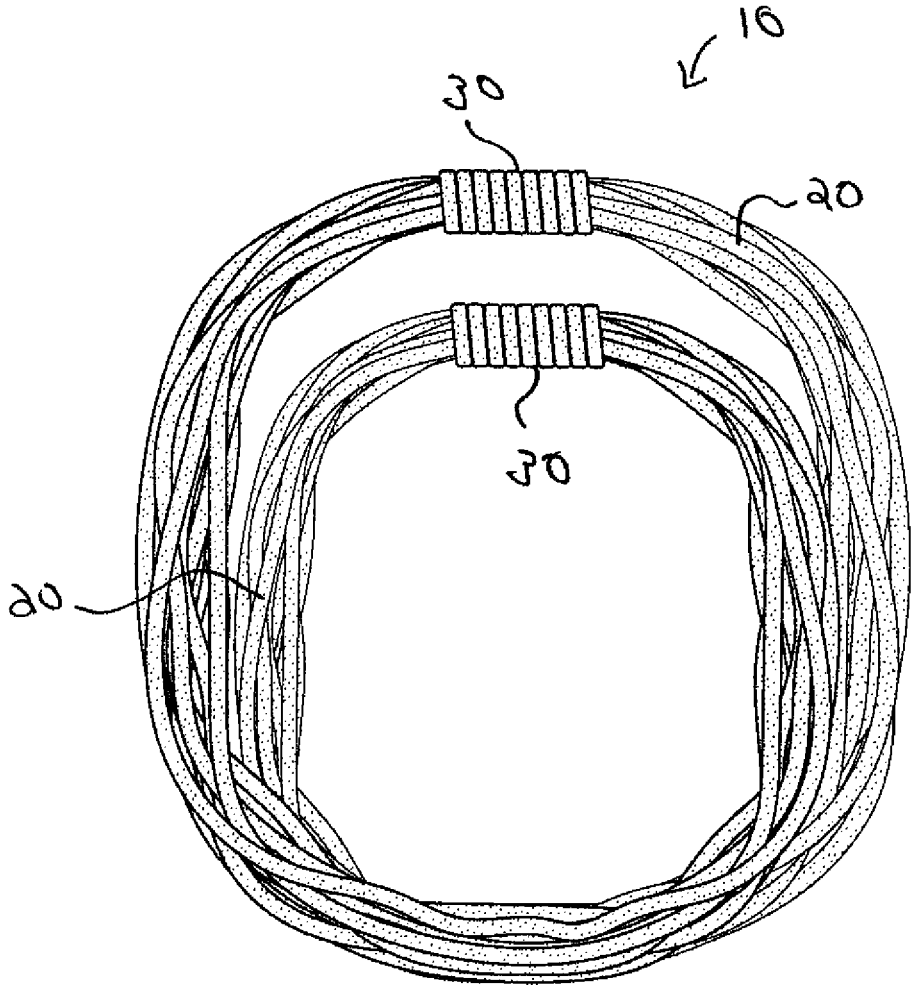
FIG. 7 is a perspective view of the neck cooler in a folded up position ready for use.
Figure 8:
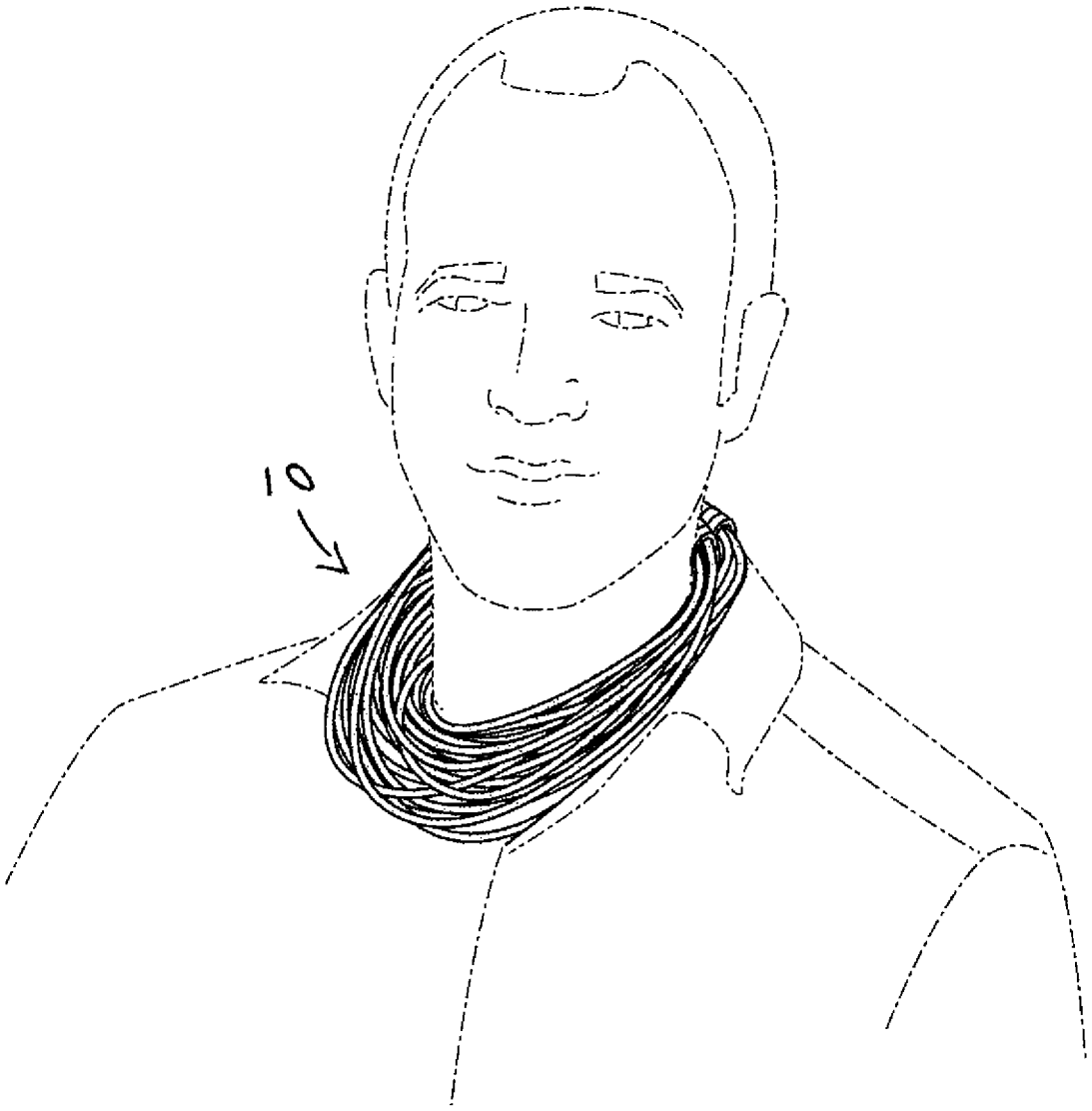
FIG. 8 is a perspective view of the neck cooler in its folded up position placed around a user's neck.

FIGS. 1 and 2 provide front and back views of neck cooler 10. FIGS. 3 and 4 provide side and top views of evaporative neck cooler 10, respectively.

Neck cooling device 10 is made from a plurality of separate circular fabric bands 20 that are stacked one on top of another. The stack of fabric bands 20 are then held together by a pair of fabric clasps 30 positioned at opposite sides of the stack of fabric bands 20.

In operation, a user simply wets device 10 (for example by pouring water on it) or by holding it underwater. At such time each of the fabric bands 20 will now be dripping with water. The user then places the device around their neck and as the water evaporates from fabric bands 20, the device will keep the user cool. The present cooling device is thus ideally suited to outdoor activities on hot summer days.

The fabric bands 20 are only tied together at opposite sides of the device. Each of the fabric bands 20 is cut from a continuous circle of material (such as an old T-shirt) and are physically separate from one another. Simply put, each fabric band 20 is a single continuous circular loop of material.

As a result, fabric bands 20 jostle around one another when placed on the user's neck such that different bands cover one another at different times. The advantage of having each of the fabric bands 20 cut from separate portions of fabric and thus be physically separate from one another is that it increases the cumulative evaporative surface area of the whole cooling device. Conversely, the advantage of having the fabric bands 20 held together in a stack (by clasps 30 on opposite sides) is that different bands are exposed to the ambient air (thereby increasing evaporation) and different bands are covered by one another at different times (thereby prolonging evaporation). What the present invention has achieved is the optimal balance between these two opposing factors—increasing surface area of evaporation (by using separate fabric strips/bands) while decreasing the overall speed of evaporation (by periodically covering one band with another as the device is jostled around).

Advantageously as well, clasps 30 are each tied together in a nail knot. The advantage of a nail knot is that it provides a smooth, comfortable surface for the wearer.

In preferred aspects, the present invention provides an evaporative neck cooling device 10, comprising: a plurality of circular fabric bands 20, wherein each of the circular fabric bands 20 is formed from a continuous circle of material and is physically separate from one another, wherein each of the circular fabric bands 20 is stacked on top of one another; and a pair of clasps 30, each clasp 30 wrapping around the stacked plurality of circular fabric bands 20, wherein each clasp 30 is made of a fabric strand tied in a nail knot around the stacked plurality of circular fabric bands 20, and wherein each of the clasps 30 is placed at opposite sides of the stacked plurality of circular fabric bands 20.

Preferably, the clasps 30 and the circular fabric bands 20 are all made of the same fabric. Most preferably, the fabric is cotton. Ideally, the plurality of circular fabric bands 20 are each cut from parallel sections of a torso of a T-shirt.

In various preferred embodiments, each of the plurality of circular fabric bands 20 has a width from ¼ to 1½ inches; and between ten to twenty five circular fabric bands 20 can be stacked on top of one another to form the device. It is to be understood, however, that the present invention also encompasses different dimensions and numbers of fabric bands.

The invention claimed is:

1. A neck cooling device, comprising a plurality of fabric bands, wherein each of the fabric bands is formed from a continuous loop of material and are physically separated from one another, and wherein each of the fabric bands is stacked on top of one another; and a clasp wrapping around the stacked plurality of fabric bands, wherein the clasp is made of a fabric strand tied in a knot around the stacked plurality of fabric bands, wherein the knot includes a plurality of wraps of fabric strands tied around the stacked plurality of fabric bands, and wherein the knot cinches and secures the fabric bands in the stack such that a portion of the fabric bands cinched and secured by the knot are fixed in place relative to the knot.

2. The neck cooling device of claim 1, wherein the knot and the fabric bands are made of the same fabric.

3. The neck cooling device of claim 2, wherein the fabric is cotton.

4. The neck cooling device of claim 1, wherein the plurality of fabric bands are each cut from parallel sections of a torso of a T-shirt.

5. The neck cooling device of claim 1, wherein each of the plurality of fabric bands has a width from ¼ to 1½ inches.

6. The neck cooling device of claim 1, wherein the plurality of circular fabric bands comprises between from 10 to 25 fabric bands stacked on top of one another.

7. The neck cooling device of claim 1, wherein the knot is a nail knot.

8. The neck cooling device of claim 1, further comprising a second knot.

9. The neck cooling device of claim 8, wherein the second knot is a nail knot.

10. The neck cooling device of claim 9, wherein the second knot is disposed opposite the knot on the neck cooling device.

11. The neck cooling device of claim 8, wherein the second knot includes a plurality of wraps of fabric strands tied around the stacked plurality of fabric bands, and wherein the second knot cinches and secures the fabric bands in the stack such that a portion of the fabric bands cinched and secured by the second knot are fixed in place relative to the second knot.

12. The neck cooling device of claim 1, wherein the stacked plurality of fabric bands are a stacked plurality of circular fabric bands.

13. The neck cooling device of claim 1, wherein the stacked plurality of fabric bands lay on one another when wet such that a portion of one or more of the stacked plurality of fabric bands is exposed to ambient air and another portion of the one or more of the stacked plurality of fabric bands is covered by another one of the one or more of the stacked plurality of fabric bands.

14. The neck cooling device of claim 1, wherein the neck cooling device absorbs water.

15. The neck cooling device of claim 14, wherein a fabric density, in terms of fabric per unit of volume, in the knot is higher than one of the fabric bands.

16. The neck cooling device of claim 15, wherein the knot absorbs more water than the fabric bands.

17. The neck cooling device of claim 14, wherein a speed of evaporation for a wet one of the fabric bands is slower than another wet one of the fabric bands in the plurality of fabric bands.

18. The neck cooling device of claim 1, wherein each one of the fabric bands in the plurality of fabric bands is a single continuous circular loop of material.

19. The neck cooling device of claim 1, wherein each one of the fabric bands in the plurality of fabric bands is ¼ to ½" wide.

20. The neck cooling device of claim 1, wherein the knot encircles each one of the fabric bands in the plurality of fabric bands and cinches the plurality of fabric bands together.

* * * * *